428-1 SR
9/14/76 XR 3,980,300

United States Patent [19]
Hornsby, Jr.

[11] 3,980,300
[45] Sept. 14, 1976

[54] AMUSEMENT BALL

[76] Inventor: James R. Hornsby, Jr., 6239 Edgewater Drive, Orlando, Fla. 32810

[22] Filed: Feb. 7, 1975

[21] Appl. No.: 548,103

[52] U.S. Cl. ..... 273/58 B; 46/1 R; 46/201; 40/327; 350/160 LC; 428/1
[51] Int. Cl.[2] ..... A63B 43/06
[58] Field of Search ..... 350/160 LC; 40/130 R, 40/327, 28 C; 424/7; 273/128 A, 61 A, 58, DIG. 24, 1 L; 46/49, 1 R, 201; 428/1

[56] References Cited

UNITED STATES PATENTS

| | | | |
|---|---|---|---|
| 984,044 | 2/1911 | Spencer | 46/49 |
| 3,441,513 | 4/1969 | Woodmansee | 424/7 X |
| 3,647,279 | 3/1972 | Sharpless et al. | 40/130 R |

*Primary Examiner*—George J. Marlo
*Attorney, Agent, or Firm*—Roylance, Abrams, Berdo & Kaul

[57] ABSTRACT

A novelty device in the form of a color-changing amusement ball comprising a spherical body member, a transparent spherical cover concentrically surrounding the body member and spaced therefrom to define a spherical cavity, and a layer of liquid crystalline material disposed within the cavity. The liquid crystalline material is responsive to temperature changes and/or deformational stresses applied thereto so that the material changes color with a change in temperature to which the ball is exposed and/or on deformation of the ball which can be accomplished by impacting the ball against a hard surface.

9 Claims, 2 Drawing Figures

AMUSEMENT BALL

Figure 1:
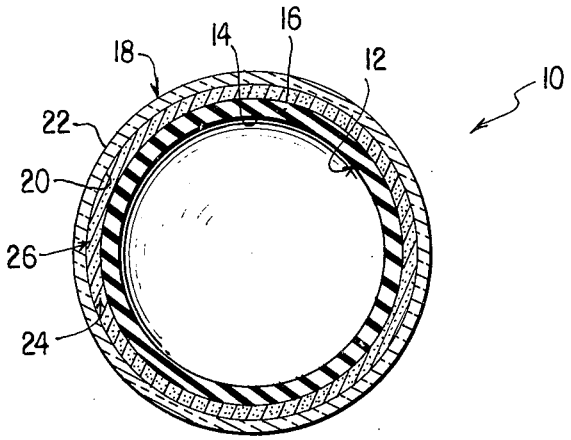

The present invention relates to an amusement ball, and more particularly relates to an amusement ball utilizing liquid crystalline material to exhibit a color change due to the impact of the ball or due to temperature changes to which the ball is exposed.

Various prior art devices are known which somehow modify a simple amusement ball to increase the amusement and enjoyment of playing with the ball. For example, some prior art devices incorporate an electrical device inside a ball to cause the illumination thereof upon impact. Additionally, it is known to apply various materials to a ball to make the ball glow in the dark.

Liquid crystalline materials are known unique types of materials which exhibit reversible color changes when subjected to temperature variations and/or deformational stresses. For example, when the temperature of such a material is elevated, the color of the material will change. When the temperature is permitted to return to its original state, the color of the material will change back to its original color. Similarly, application of deformational stresses to such materials causes a color change to occur. After the deformational stress is released, the crystals become re-aligned and the color changes back to the original color. Liquid crystalline materials of this type have heretofore been used primarily in display devices.

It is therefore a primary object of the present invention to provide a unique and highly enjoyable amusement device which combines the attributes and characteristics of a ball and liquid crystalline material.

A more specific object of the present invention is to provide an amusement ball which changes color with a change in temperature to which the ball is exposed.

A further object of the present invention is to provide an amusement ball which changes color on impact of the ball against a hard surface.

A further object of the present invention is to provide an amusement ball changeable in color both on an impact with a hard surface and on a change in temperature.

These objects are attained by providing a novelty device in the form of an amusement ball which comprises a spherical body member, a tranparent spherical cover concentrically surrounding the body member and spaced therefrom to define a spherical cavity therebetween, and a layer of liquid crystalline material disposed within the cavity. The liquid crystalline material utilized is responsive to temprature changes and/or deformational stresses applied to the material. The spherical body member can take the form of a conventional rubber ball which is deformable or a rigid ball made, for example, of rigid plastic. Additionally, the spherical body member can be made in the form of a flexible, plastic inflatable ball, such as a "beach ball."

Other objects, advantages and salient features of the present invention will become apparent from the following detailed description, which, taken in conjunction with the annexed drawings, discloses a preferred embodiment of the present invention.

Figure 2:
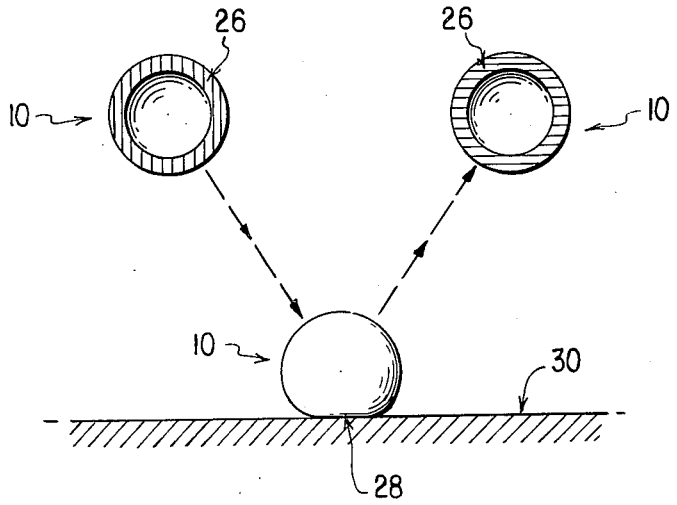

Referring now to the drawings which form a part of this original disclosure:

FIG. 1 is a sectional view taken along the diameter of a spherical amusement ball in accordance with the present invention; and FIG. 2 is an elevational view, in schematic form, showing an amusement ball in accordance with the present invention changing color on being bounced against a hard surface.

Referring now to FIG. 1 in further detail, the amusement ball in accordance with the present invention is generally designated 10 and comprises a spherical body member 12, a transparent cover 18 and liquid crystalline material 26 interposed between the spherical body member and the cover.

The spherical body member 12 has an inner spherical surface 14 and an outer spherical surface 16. This body member may be formed of rigid material, such as rigid plastic, or may be formed of deformable material, such as rubber. Additionally, the body member may be formed of a flexible plastic material which can be inflated. The spherical body member can also be formed of transparent material and the outer surface 16 can be either light reflecting or absorbing in order to vary the scattering effect of the light striking the liquid crystalline material.

The cover 18 has an inner spherical surface 20, which has a diameter greater than the diameter of the outer spherical surface 16 of the spherical body member, and an outer spherical surface 22. Defined between the outer spherical surface 16 of the spherical body member 12 and the inner spherical surface 20 of the cover 18 is a spherical cavity 24. The cover 18 is formed of transparent material, such as plastic film, one suitable type being that sold under the trademark MYLAR. The cover 18 is also preferably formed of deformable material.

The liquid crystalline material 26 is interposed in the cavity 24 between the outer surface 16 of the spherical body member 12 and the inner spherical surface 20 of the cover 18. The liquid crystalline material used is capable of reversible variable light scattering at room temperatures and exhibits a variable light scattering characteristic modified by temperature changes and/or when the material is subjected to mechanical deformation, such as occasioned by shear stresses or compression forces.

Liquid crystalline materials which exhibit the required color change with a change in temperature are disclosed in U.S. Pat. No. 3,441,513, issued to Woodmansee, especially in columns 3–8, the disclosure of such patent being specifically hereby incorporated by reference.

Liquid crystalline materials which exhibit a variable light scattering characteristic, or color change, when subjected to mechanical deformation can be those materials disclosed in U.S. Pat. No. 3,647,279, issued to Sharpless et al., especially those materials disclosed in columns 11–13, the disclosure of such patent being hereby specifically incorporated by reference.

In constructing the amusement ball in accordance with the present invention, either the liquid crystalline material 26 is first coated on the outer surface 16 of the spherical body member 12 and then the cover 18 is applied over the layer of liquid crystalline material, or the liquid crystalline material is first coated on the inner surface 20 of the cover 18 and then the material and the cover combination are applied to the outer surface 16 of the spherical body member 12.

In utilizing the amusement ball formed in accordance with the present invention, it is contemplated that a color change will be effected by either an individual grasping the ball, in which case the liquid crystalline material reacts to the heat given off by the hand of the individual, or by bouncing the amusement ball against a hard surface, in which case the change in color is effected by a deformation of the ball. Additionally, both of these actions, i.e., grasping the ball and bouncing the ball, can be used to provide a color change to the ball, in which case liquid crystalline material having heat sensitive and deformation sensitive characteristics are utilized in the cavity 24. It should be pointed out that these characteristics are reversible, so on removal of the increase in temperature (by releasing the ball) or on removal of the deformational force (after a bounce) the color of the liquid crystalline material returns to the original color.

As illustrated in FIG. 2, when the ball 10 is dropped or thrown against a hard surface 30, a deformation, shown by character numeral 28, results which causes a change in color of the liquid crystalline material within the cover from, for example, red (before impact) to, for example, blue (shortly after impact), the change in color being visible through the transparent cover 18.

Depending on the force of the impact and the materials used to form the cover 18 and the spherical body member 12, the deformation 28 shown in FIG. 2 takes place in the cover 18, the liquid crystalline materials 26 and the spherical body member 12.

Thus, a novelty device in the form of an amusement ball is capable of changing color either on grasping of the ball or throwing of the ball against a hard surface, or both, thereby providing an enjoyable amusement device in a convenient package.

While various embodiments have been chosen to illustrate the invention, it will be understood by those skilled in the art that various changes and modifications can be made therein without departing from the scope of the invention as defined in the appended claims.

What is claimed is:

1. An amusement device in the form on a play ball comprising:

body member in the shape of a sphere adapted to be bounced and impacted in play;

a transparent spherical cover means concentrically surrounding said body member and spaced therefrom to define a spherical cavity therebetween; and a layer of liquid crystalline material disposed within said cavity.

2. An amusement device according to claim 1, wherein said liquid crystalline material has characteristics of selective light scattering which are variable with deformational stress applied to said material.

3. An amusement device according to claim 1, wherein said liquid crystalline material has characteristics of selective light scattering which are variable with the temperature of said material.

4. An amusement device according to claim 1, wherein said body member is formed of deformable material.

5. An amusement device according to claim 1, wherein said body member is formed of substantially rigid material.

6. An amusement device according to claim 1, wherein said body member is formed of transparent material.

7. An amusement device according to claim 1, wherein said body member has a light reflective outer surface.

8. An amusement device according to claim 1, wherein said body member has a light absorbing outer surface.

9. An amusement device according to claim 1, wherein said body member is formed of flexible material.

* * * * *